US010022606B2

(12) United States Patent
Haro

(10) Patent No.: US 10,022,606 B2
(45) Date of Patent: Jul. 17, 2018

(54) TRAINING BAT

(71) Applicant: Ernest Haro, San Jose, CA (US)

(72) Inventor: Ernest Haro, San Jose, CA (US)

( * ) Notice: Subject to any disclaimer, the term of this patent is extended or adjusted under 35 U.S.C. 154(b) by 0 days.

(21) Appl. No.: 14/672,039

(22) Filed: Mar. 27, 2015

(65) Prior Publication Data

US 2015/0273305 A1 Oct. 1, 2015

Related U.S. Application Data

(60) Provisional application No. 61/972,233, filed on Mar. 29, 2014.

(51) Int. Cl.

| | |
|---|---|
| ***A63B 69/00*** | (2006.01) |
| ***A63B 59/00*** | (2015.01) |
| ***A63B 59/55*** | (2015.01) |
| ***A63B 59/52*** | (2015.01) |
| *A63B 59/40* | (2015.01) |

(52) U.S. Cl.

CPC ..... *A63B 69/0002* (2013.01); *A63B 59/52* (2015.10); *A63B 59/55* (2015.10); *A63B 59/40* (2015.10); *A63B 2069/0008* (2013.01); *A63B 2208/0204* (2013.01)

(58) Field of Classification Search

CPC ..... A63B 59/50; A63B 69/02; A63B 69/0002; A63B 43/002; A63B 59/00; A63B 67/00; A63B 59/55; A63B 59/52

USPC ..... 473/457, 422, 454, 564, 8; D21/725

See application file for complete search history.

(56) References Cited

U.S. PATENT DOCUMENTS

| | | | | | |
|---|---|---|---|---|---|
| 805,132 | A * | 11/1905 | Gubbins | A63B 60/48 | 473/564 |
| 3,104,876 | A * | 9/1963 | Salsinger | A63B 59/50 | 473/568 |
| D197,180 | S * | 12/1963 | Salisbury | D21/725 | |
| 3,246,894 | A * | 4/1966 | Salisbury | A63B 69/0002 | 473/457 |
| 3,618,942 | A * | 11/1971 | Bates | A63B 21/04 | 473/229 |
| 3,880,423 | A * | 4/1975 | Kreag | A63B 59/50 | 473/566 |
| 4,052,065 | A * | 10/1977 | Rodriquez | A63B 67/12 | 473/564 |
| 4,079,936 | A * | 3/1978 | Schachter | A63B 59/00 | 463/47.2 |
| 4,149,723 | A * | 4/1979 | Simon | A63B 43/002 | 473/569 |
| D259,501 | S * | 6/1981 | Salisbury | D21/725 | |

(Continued)

*Primary Examiner* — Mitra Aryanpour

(74) *Attorney, Agent, or Firm* — John C Merchant

(57) ABSTRACT

A training bat having an elongated barrel of a substantially rectangular cross-sectional shape, a relatively short tapered section and a handle section with knob, wherein the hitting surface is substantially flat with rounded edges and is of a lesser width front to back than each side of the barrel and provides a relatively longer than the hitting surface of a standard bat having a standard cylindrical shaped barrel. The hitting surface and is oriented relative to the grain of a wood embodiment such that the grain of the bat will be perpendicular to the ball at contact. The elongated barrel and short tapered section create a longer sweet spot which extends further toward the handle than a standard bat. The barrel has uniformly perpendicular sides extending from the tapered section to the top of the bat.

15 Claims, 7 Drawing Sheets

(56) References Cited

U.S. PATENT DOCUMENTS 4,445,687 A * 5/1984 Merritt ..... A63B 59/50 473/564
4,836,541 A * 6/1989 Henley ..... A63B 69/0002 473/457
4,892,303 A * 1/1990 Lohre ..... A63B 69/02 463/47.1
D357,289 S * 4/1995 Cramton ..... D21/725
5,490,669 A * 2/1996 Smart ..... A63B 59/50 473/564
D397,385 S * 8/1998 LaBorde ..... D21/725
6,010,417 A * 1/2000 Young ..... A63B 59/50 473/564
6,319,157 B1 * 11/2001 Broadbent ..... A63B 59/50 473/446
D543,251 S * 5/2007 Kelliher ..... D21/725
D652,879 S * 1/2012 Vigness ..... D21/725
8,282,510 B1 * 10/2012 Englund ..... A63B 59/50 473/422
D702,781 S * 4/2014 Paxson ..... D21/725
2009/0325736 A1 * 12/2009 Carsello ..... A63B 69/0002 473/457
2009/0325737 A1 * 12/2009 Windsor ..... A63B 69/0002 473/457
2010/0267499 A1 * 10/2010 Magno ..... A63B 15/00 473/457
2010/0311525 A1 * 12/2010 Cornford ..... A63B 59/55 473/457
2011/0250994 A1 * 10/2011 Budzielek ..... A63B 69/0002 473/457
2014/0274496 A1 * 9/2014 Sample ..... A63B 59/06 473/564
2015/0251069 A1 * 9/2015 Tekerman ..... A63B 69/0002 473/457
2015/0273305 A1 * 10/2015 Haro ..... A63B 69/0002 473/457

* cited by examiner

PRIOR ART INVENTION

TRAINING BAT

CROSS-REFERENCE TO RELATED APPLICATION

The present non-provisional application claims the benefit of commonly assigned provisional application having Ser. No. 61/972,233 filed Mar. 29, 2014, entitled TRAINING BAT which application is incorporated herein by reference in its entirety.

FIELD OF INVENTION

The present invention relates generally to a ball bat for use in sports training.

BACKGROUND

The game of baseball is engaged in by players of a range of age and skill. Players participating in each level of play, from Little League to the Major Leagues, must work to develop and maintain playing skills in order to achieve success. One key skill, "batting skill", is particularly difficult to acquire and requires hours of practice, development of proper swing mechanics, development of strength, eye/hand ability, coordination and feel. It is commonly said that the act of making consistent solid contact with a round ball traveling at speed using a round bat may be the most difficult thing to do in sport. Developing confidence in doing so is even more difficult. Current training devices (in particular standard bats) present problems which are detrimental to developing skill and confidence.

One problem with standard bats is that off center hits cause a shock or "sting" to a batter's hands at impact. This problem is most pronounced when the ball impacts the barrel of the bat at a location along its length which is off of the area comprising the center of percussion, or "sweet spot" of the bat. This sting can cause a hitter to become anxious or otherwise fearful of making a hard swing at the ball.

A related problem is the difficulty of making contact with the sweet spot of the bat. The sweet spot of a bat (in general terms) is that area of the bat barrel which, when striking the ball, causes a maximum transfer of energy and a minimum transfer of vibration to the hands of the batter. With standard cylindrical bats, the sweet spot is relatively small compared to the diameter and length of the bat barrel. As a result it is difficult for developing hitters to make solid contact with it. A bigger bat barrel will have a bigger sweet spot but will also be heavier which is problematic for children or other developing hitters who have not yet developed adequate strength. Bats made of wood are used in the Major Leagues for various performance reasons and because they emit a preferable feel and sound to bats made of metal or composite materials when the ball is struck squarely. But bats made of wood, as stated, that have larger barrel diameters are too heavy for many batters to swing. And hollow bats made of metal or composite materials do not have a desirable feel and sound.

A big problem associated with wood bats is breakage. Broken bats are common in the Major Leagues where they are used to make contact with balls thrown at relatively high velocity. But, bat breakage at lower levels (even Little League levels) is problematic because bats made of wood (though relatively inexpensive to make and pleasing to use) are likely to break of splinter if the ball makes contact with the grain of the wood. The batter needs to hold a wood bat such that the ball makes contact against the grain of the wood barrel (i.e. for purposes of example, like striking the end of a deck of cards). This is difficult for young or developing hitters who haven't developed the focus (in paying attention to the grain), the training (from coaches, parents and others in how to hold the bat), or the strength (in terms of maintaining their grip on the bat as they make a swing to insure the bat doesn't turn in their hands before impact) to make proper contact using a wood bat. Thus, use of wood bats is discouraged in youth levels in games and/or in training, because wood bats break and are expensive to constantly replace and/or to reduce the risk of persons being injured by a broken or splintered bat.

Another problem associated with standard bats is that they do not encourage development of a level swing. It is preferable for hitters to develop level swings—that is swing the barrel at a plane where the barrel travels relatively parallel with the ground and as it enters the hitting zone—because balls are thrown so that they approach the strike zone on a substantially level plane. A level swing through the strike zone generally results in more consistent and solid contact with the ball. The roundness of the bat barrel makes it difficult for developing hitters to visualize that portion of the bat that they want to make contact with the ball. And, the roundness does not assist in providing an aerodynamic indication (that is difference in feel as the swing is being made) of when the swing is adequately level and when it is not.

As a result of these problems with standard cylindrical bats, developing hitters become fearful or anxious when making a swing, have difficulty making solid contact with the ball, miss out on the enjoyment of utilizing a wood bat, and otherwise have difficulty developing proper swing mechanics.

SUMMARY OF INVENTION

The present invention provides a training bat for use in ball sports including but not limited to baseball and softball which is adapted to address the problems and shortcomings associated with the prior art. A preferred embodiment of the bat has a elongated barrel of a substantially rectangular cross-sectional shape connected with a handle by a short tapered section. The hitting surface of the barrel is substantially flat with rounded edges and is of a lesser width front to back than each of the two parallel sides. The hitting surface of a preferred embodiment of the bat constructed in wood material is oriented such that the gran runs against the ball at contact thus making the hitting surface uniformly stronger than a standard cylindrical wood bat. The hitting surface provides for a narrower and relatively longer sweet spot than the standard cylindrical bat.

DETAILED DESCRIPTION OF PREFERRED EMBODIMENTS

Various embodiments consistent with the principles of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments. The training bat described herein is designed for ball sports including but not limited to baseball and softball.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Figure 1A:
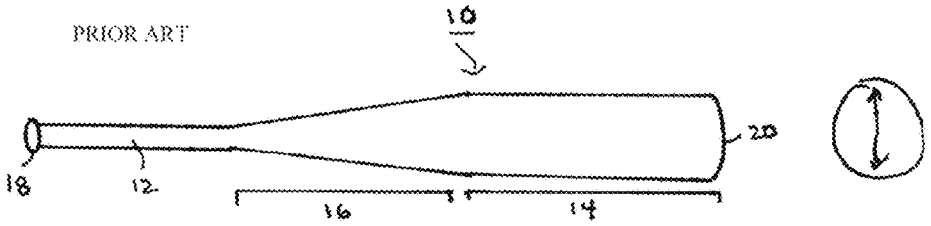
FIG. 1A, FIG. 1B, and FIG. 1C provide a perspective view comparison showing one view of a standard ball bat (FIG. 1A) and two views (FIG. 1B and FIG. 1C) of an embodiment of the training bat consistent with the principles of the invention. Each view shows the elements of the bat as well as a cross section of the barrel portion showing grain direction of a wood embodiment relative to the hitting surface.
Figure 1B:
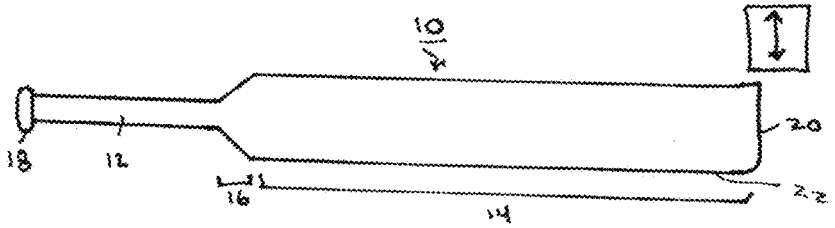
Figure 1C:
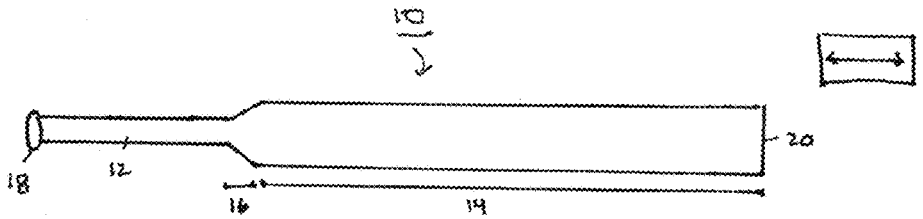

Turning now in detail to the drawings, FIG. 1A, FIG. 1B and FIG. 1C compare the relative dimensions of the elements of a standard baseball or softball bat to an embodiment of a training bat consistent with the principals of the invention. FIG. 1A shows a standard bat which is cylindrical in cross section and thus similar from all sides. The embodiment of the training bat shown in FIGS. 1B and 1C has a four sided elongated rectangular barrel. FIG. 1B shows the training bat barrel having a longer width at the top/bottom sides. In FIG. 1B, the training bat is laid on its side showing the top or bottom side of the barrel. In FIG. 1C the training bat is laid flat showing the narrower hitting side of the training bat. One will note from the drawings that the standard bat depicted in FIG. 1A as similar elements to those shown in the embodiment of the training bat shown in FIG. 1B and FIG. 1C 10 including a handle 12, an elongated barrel 14, a tapered section 16 joining the handle 12 to the barrel 14, knob 18 or similar structure at the free end of the handle 12 and end 20 or cap at the distal end of the barrel 14. The relative length of the tapered section 16 is substantially reduced and the relative length of the barrel 14 is substantially increased in the training bat. In other words, the hitting area of the training bat is substantially longer than that of the standard bat. Further, the barrel of the training bat as shown in FIGS. 1B and 1C is four sided, elongated, and uniformly rectangular along the length of the barrel with a narrower width at the front side hitting surface 22 and back side surface opposite the hitting surface than the right and left side surfaces which, in a preferred embodiment, run substantially perpendicular to the hitting surface. The front side hitting surface 22 of the barrel 14 is flat except for rounded edges where it meets the sides and top (or cap) portion. The side surfaces are uniform in length and width along the barrel length, the width of the side surfaces being greater than the width of the front side hitting surface along the barrel length. Each of the four sides of the barrel are the same length as shown. Looking at the horizontal cross-sectional views of FIGS. 1B and 1C, one will note that the front side hitting surface 22 of the training bat has a width which is greater than the width of the handle. The width of the handle shown in FIG. 1 C is roughly one-half the width of the hitting surface 22. Further, the wood barrel of the preferred embodiment is oriented such that the edge grain of the bat will meet the ball at contact with the hitting surface. The common explanation for hitting on the edge-grain face of wood bat is that this type of contact is like hitting on the edge of a "deck of cards". Because edge-grain face contact is parallel to the dense latewood growth rings, the impact forces are transferred solidly across the diameter of the bat barrel. Thus, the a ball striking the edge grain will be more solid and provide less vibration to the handle than when a ball strikes the flat faced grain (or the face of a deck of cards). Because of the relative strength differences between the edge grain and the flat face grain, wood bats tend to break when struck by a ball traveling at a relatively high velocity (such as that thrown by a pitcher in a baseball game). For this reason, the label of a standard cylindrical bat is placed on the flat grain face to easily indicate to the batter that portion of the bat which he/she should use to more effectively strike the ball. The usual instruction to hitters is to swing with the label up so that the ball is more likely to strike the edge grain of the bat. With the present invention, the hitting surface is oriented such that it is at the edge grain. If the hitter makes contact with the ball at the hitting surface, he/she will be making contact at the edge grain thus receiving a more solid hit.

In the particular embodiments, the training bat 10 may be made of wood though it may alternatively be made of one or more composite or metallic materials. Some examples of suitable composite materials include fiber-reinforced glass, graphite, boron, carbon, aramid, ceramic, Kevlar, or Astroquartz®. Aluminum or another suitable metallic material may also be used to construct the bat. A training bat 10 including a combination of metallic and composite materials may also be constructed. For example, a training bat 10 having a metal barrel and a composite handle, or a composite barrel and a metal handle, may be used in the embodiments described herein. All bats used in Major League Baseball are made of wood for various reasons largely having to do with performance, feel and sound.

Wooden baseball and softball bats are typically formed from a single piece of ash wood, ash having desirable properties of hardness and strength. To produce a finished standard cylindrical baseball bat, a rectangular billet either rectangular or circular in cross-section is created in an appropriate length and diameter, typically approximately 37 inches long and approximately 2 and ¾ inches in width or diameter. The billet is cut so that the grain of the wood runs longitudinally, and is preferably taken from an outer section of the tree so that the grain runs in a relatively planar manner with as little curvature as possible. The billet is then shaped on a lathe to the particular desired length and profile, the bat having a thick striking portion or barrel, which is tapered into a relatively thin handle portion with a knob on the handle end. An infinite variety of profiles is possible. When striking the ball, a wooden bat is strongest against the grain, i.e., on the edge grain or when the striking angle is generally parallel to the face plane of the grain, meaning that there are only two optimum striking faces on each bat. If the player improperly rotates the bat so that the ball hits the bat too far off the exposed edge grain and onto the face grain, (which is easy to do with a standard cylindrical bat), the bat is more likely to crack or break. A preferred embodiment of the training bat is shaped to allow for a substantially rectangular barrel and oriented such that the shorter sides (including the hitting surface) expose the edge grain and the longer sides expose the face grain. The entire length of the hitting surface of the training bat exposes the strongest portion of the barrel upon which to make contact with the ball. The tapered area and handle may be cylindrical or substantially rectangular as shown in the drawings.

Thus, the knowledge and skill of the batter dictates, to some degree, the likelihood that a wood bat will break during use (for training or games) because the batter has to be careful to position the bat in his/her hand and swing such that the ball will hit the bat against the edge grain (i.e. where the bat is strongest). This is a substantial problem for children and others just learning to hit because it difficult to make consistent solid contact with the ball at that location on the bat where the grain is strongest. And, as a result, use of wood bats for children is discouraged not only for economic reasons (i.e. too many bats need to be replaced) but to reduce the risk of injury resulting from the sharp end or splinter of a broken bat. As discussed in detail below, one advantage of the present invention is that a batter striking the ball on the hitting surface will almost always strike the ball against the grain.

Figure 2A:
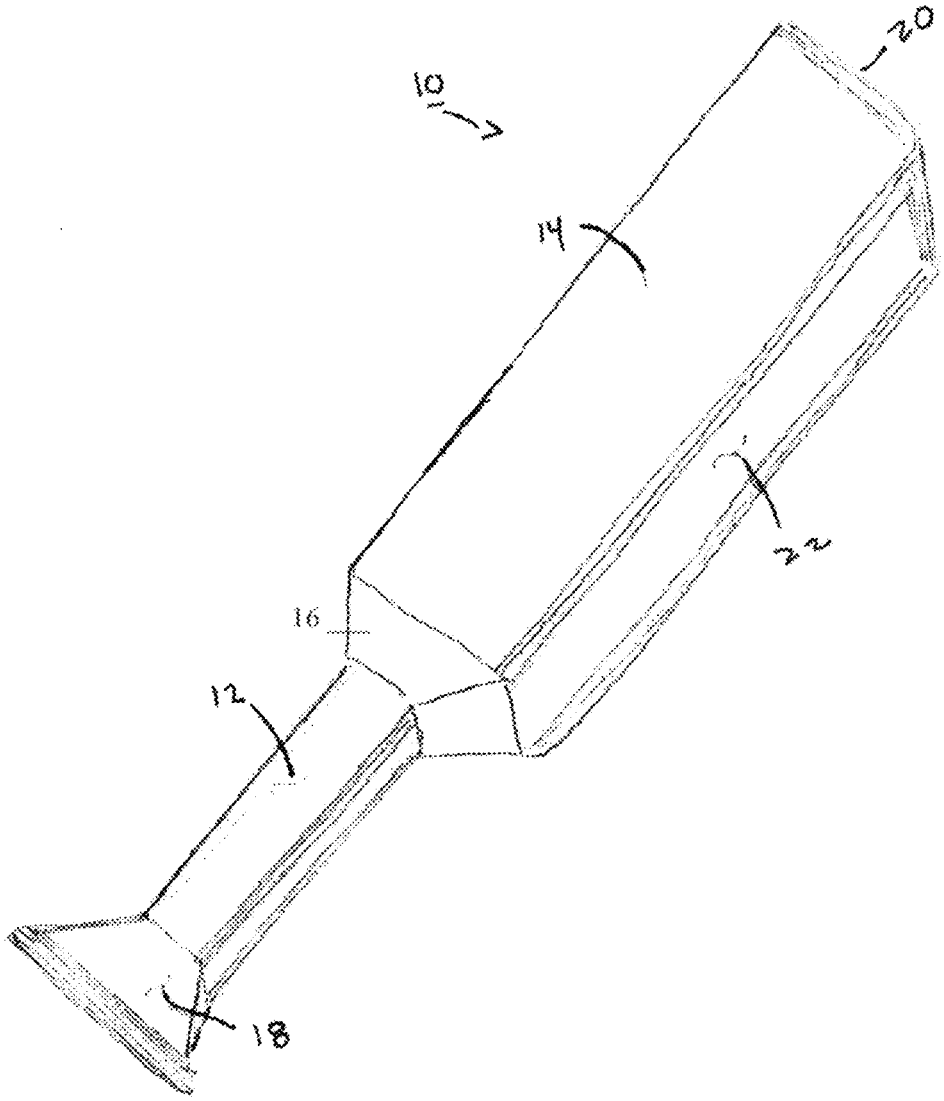
FIG. 2A is a perspective view of an embodiment of the training bat consistent with the principles of the invention showing the hitting surface.
Figure 2B:
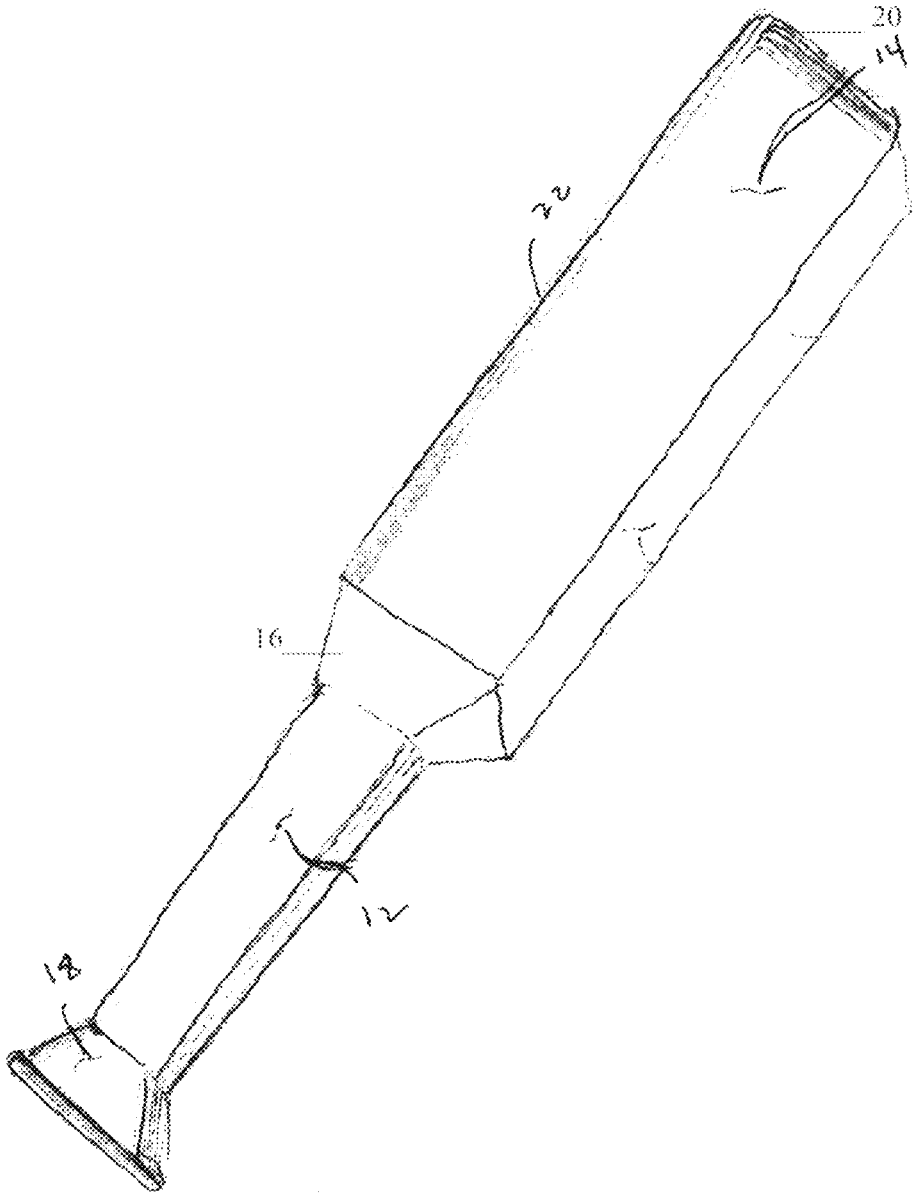
FIG. 2B is a perspective view of an embodiment of the training bat consistent with the principles of the invention showing a surface opposite of the hitting surface.

FIG. 2A and FIG. 2B both show perspective views of an embodiment of the training bat consistent with the principles of the invention. In FIG. 2A, the training bat is positioned so that the front side hitting surface 22 is exposed. The front side hitting surface of the training bat is flat with rounded edges at its intersection with the top and bottom sides, the tapered section 16 and the cap 20. The rounded edges are to prevent the ball from being cut by the bat should the ball be hit off center and against one of the edges. One will note from FIG. 2A that the tapered section 16 of this embodiment has flat sides. Alternatively, the tapered section 16 may be conical. In alternative embodiments, the tapered section may be eliminated such that the handle is connected directly with the barrel. As previously noted, the front side of the barrel that makes up the hitting surface is shorter in width than the two adjacent parallel right and left sides for several reasons. For example, the wider sides of the barrel affect the aerodynamics of the training bat 10 during the swing. It is easier for the batter to swing the training bat 10 with the narrower side forward (i.e. toward the oncoming ball) than it is to swing with the top or bottom side forward which will cause more wind resistance. Thus, the rectangular shape encourages the hitter to hit the ball on the hitting surface. Also, wider right and left barrel sides makes the bat stronger at impact (which is particularly useful when the bat is made of wood). Further, the wider sides reduce the flex of the barrel at impact with the ball, thus effectively lengthening and widening the sweet spot relative to the standard cylindrical bat. The barrel of the training bat shown in FIG. 2A is rectangular in cross section along the entire barrel length. One will also note that the embodiment shown in FIG. 2A has a handle which is substantially square in cross section to allow the hitter to feel the orientation of the hitting surface more easily in his/her hands during the swing. FIGS. 2A and 2B show the handle having a four sided knob 18 which his square in horizontal cross section and increases in width from the handle to the distal end opposite the barrel cap. In alternative embodiments, the handle and knob may be rectangular or cylindrical in cross section. Also shown in the preferred embodiment depicted in FIG. 2B, the tapered section 16 is rectangular in cross-section. In alternative embodiments, the tapered section 16 may be eliminated such that the handle is directly connected with the barrel. However, the tapered section 16 of the preferred embodiment ads strength. In alternative embodiments, the barrel, tapered section and handle may be made of different or a combination of materials.

Width of the front side hitting surface. In preferred embodiments, the width of the front side hitting surface 22 of the training bat is functionally in the range 1⅝" to 2". A standard baseball is 2⅞" to 3" in diameter. Thus, it is preferable that the training bat have a hitting surface of approximately 2" wide for making solid contact with the ball. It would be difficult to make consistent contact with a standard ball using a hitting surface with a width smaller than 1½" although smaller hitting surface widths could be used in embodiments utilized by skilled hitters. The diameters of standard cylindrical bat barrels are typically 2¼" to 2¾". But the cylindrical nature of the standard bat means that the hitting surface (which may be defined as a surface upon which the batter may make contact and have the ball travel in the direction of the swing) on a standard bat is round and, while the material compresses at impact with the ball, there is actually less than 1" of hitting surface contacting the ball at impact. In other words, while there may be more area of the bat to make contact with the ball with a standard cylindrical barrel bat, making contact outside of the hitting surface would cause the ball to glance off the bat in an unintended up or down direction (such as will a foul ball). Thus, the hitting surface of the training bat is functionally wider than the hitting surface of the standard cylindrical bat because contact with any portion of the hitting surface will result in the ball traveling in the relative direction of the swing and would only glace off if struck at the rounded edges where the hitting surface meets the adjacent perpendicular side of the barrel.

Width of the hitting surface relative to the perpendicular sides. The width of the front side hitting surface relative to the right and left side surfaces can vary except that it is preferable that the front side hitting surface be roughly half as wide at the adjacent right and left perpendicular sides of the barrel for purposes of providing aerodynamics which would encourage proper swing mechanics and because wider perpendicular sides will preserve strength and reduce flex of the barrel at impact as discussed above.

Length of the hitting surface relative to the bat length. Generally, the length of the hitting surface of the standard bat as well as the training bat will be greater than the length of the handle and tapered section combined. The length of the barrel (i.e. the hitting surface) of the embodiment shown in FIGS. 1B and 1C is roughly two-thirds the length of the handle and tapered sections combined. The length and width of the hitting surface is generally relative to the overall length of the bat. As shown in the Figures, the length of the hitting surface 22 of the training bat may be roughly one-half to two-thirds of the length of the training bat 10. So, for example, a 21" training bat may have a 10" knob/handle, a 10" hitting surface and a 1" tapered section. A 24" training bat may have a 10" knob/handle portion, a 12" hitting surface, and a 2" tapered portion. A 27" training bat may have an 11" knob/handle, a 15" hitting surface, and a 1" tapered section. A 30" training bat may have all" knob/handle, a 18" hitting surface and a 1" tapered section. While it is possible in alternative embodiments to have a hitting surface that is substantially shorter than one-half the length of the training bat, a shortening the length of the hitting surface will reduce the length of the sweet spot. Advanced hitters who don't need as much length in sweet spot to make consistent and solid contact, may prefer a hitting surface length more consistent with the length of the standard bat barrel. However, unskilled hitters (particularly children) who have difficulty making contact with the ball at the end of the bat will develop more confidence having a longer hitting surface.

FIG. 2B shows a similar embodiment of the training bat 10 as shown in FIG. 2A except that the back side opposite the front side hitting surface is shown. In this embodiment, the back side opposite the front side hitting surface is flat without rounded edges. This may encourage the hitter to hit using the front side hitting surface and because only one hitting surface is necessary. Nevertheless, alternative embodiments may have hitting surfaces on both front and back opposing sides with rounded edges on each. Note that the preferred embodiment shown in FIGS. 2A and 2B has a front hitting surface which is identical in length to the side surfaces and the width of the hitting surface is uniform along its entire length. As shown, the four sided barrel has opposite sides which are flat and parallel to one another along the barrel length.

Alternative configurations of the barrel. An alternative embodiment may utilize a barrel having a trapezoidal, rather than rectangular shape. In this alternative configuration, the right and left side surfaces aren't parallel but instead extend from a front side hitting surface that is wider to an opposing back side (which may or may not have a hitting surface) that is relatively narrower than the front side. For example, such alternative embodiment might have one front side hitting surface that is 2" wide with an opposing back side of 2½" with right and left sides roughly 3½" to 4" wide. Such configuration is consistent with the principle that the hitting surfaces are flat with rounded edges and extend at a consistent width down the length of the barrel. A variety of barrel shapes are consistent with the principles described above.

Figure 3:
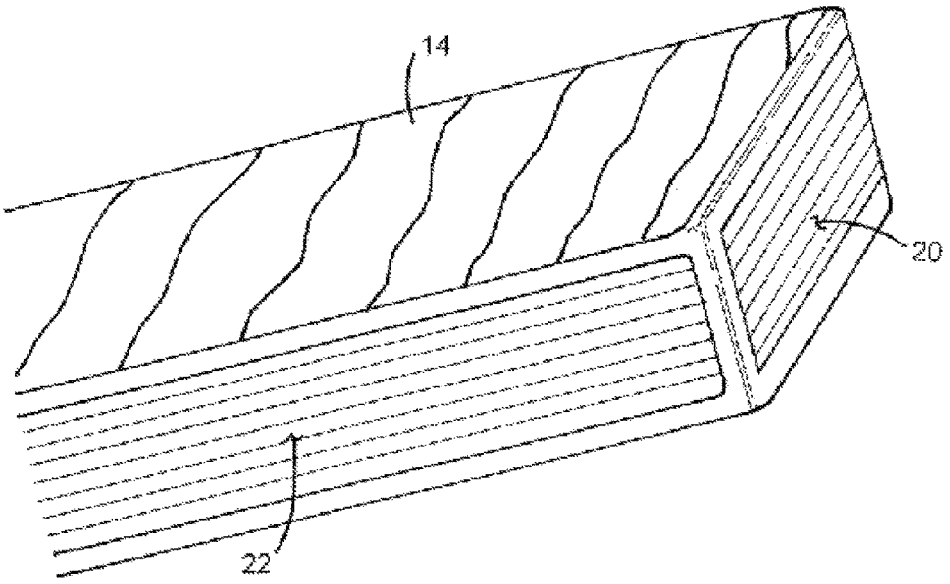
FIG. 3 is a perspective view of an embodiment of the training bat consistent with the principles of the invention showing the direction of the grain relative to the hitting surface.

FIG. 3 is a perspective view of the barrel end portion of an embodiment of the training bat 10 having a four sided rectangular elongated barrel made out of wood. The drawing shows the grain of the wood relative to the front side hitting surface 22 of the training bat 10. It shows rounded edges at the end portion in connection with all sides except the back side opposite from the front side hitting surface. This is for increased aerodynamics and safety. The end side 20 (or cap) is flat and located at the distal end of the barrel as shown. In alternative embodiments, the end side 20 may be rounded on all edges or rounded only at that edge where it meets the front or back side hitting surface(s).

Figure 4:
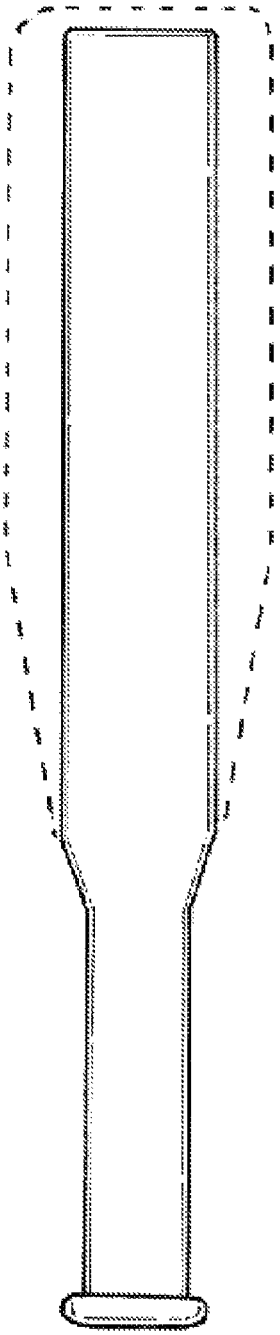
FIG. 4 is an overlapping comparison view of a standard bat and an embodiment of the training bat consistent with the principles of the invention showing the relative length and width of the hitting surface.
Figure 5:
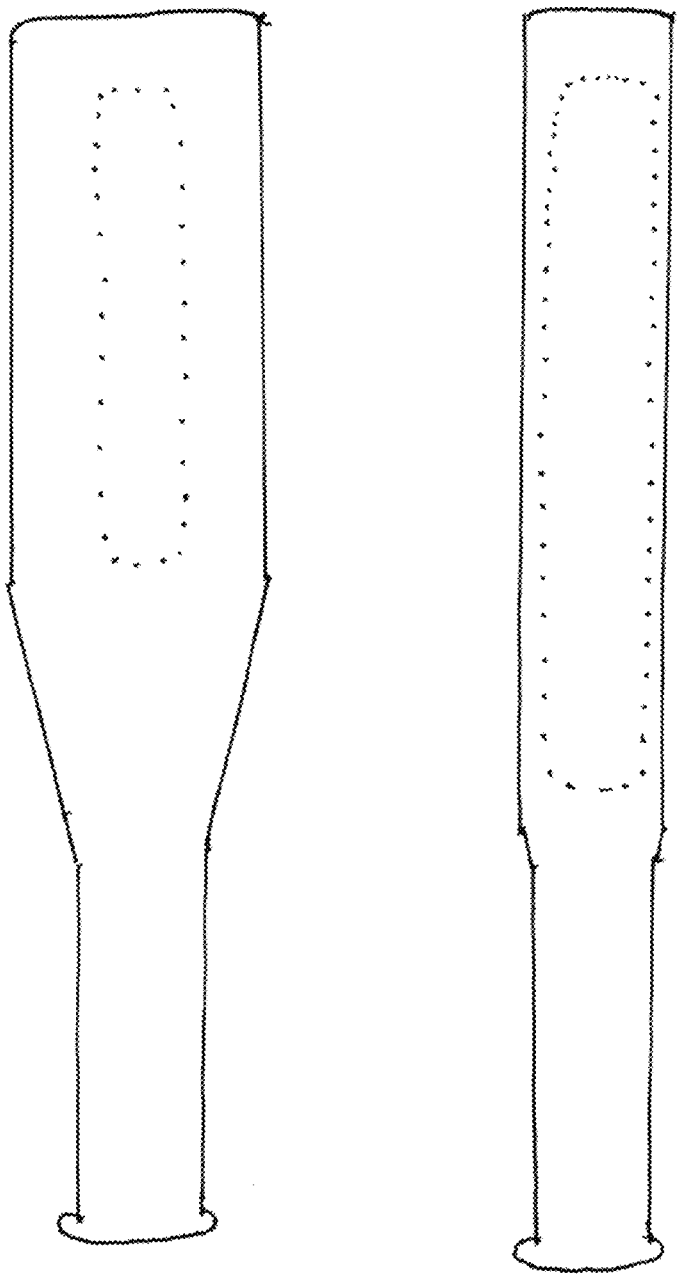
FIG. 5 is a comparison view of a standard cylindrical barreled bat (on the left) and an embodiment of the training bat (on the right) consistent with the principles of the invention.

FIG. 4 is an overlapping comparison view of a standard bat (shown in dashed lines) and an embodiment of the training bat (shown in solid lines) showing the relative lengths of overall surface area of the barrels with hitting surface facing forward. The ball striking area of a standard bat typically extends throughout the length of the barrel, and may extend partially into the tapered section of the bat. A bat barrel generally includes a maximum performance location or "sweet spot," which is the impact location where the transfer of energy from the bat to a ball is maximal, while the transfer of energy to a player's hands is minimal. In a conventional bat, the sweet spot is typically about 2-4 inches from the distal end of the barrel and extending toward the tapered portion. The sweet spot has a width and a length. FIG. 5 shows the approximate comparative location of the sweet spot for the standard bat relative to that of the training bat. Note that the sweet spot of the training bat is significantly longer and wider than that of the standard bat relative to the length and width of the hitting surface because the hitting surface of the training bat is relatively flat and is of consistent width (i.e. does not taper) as it extends down toward the tapered section.

Fig. shows 5 is a comparison view of a standard cylindrical bat (on the left) and an embodiment of the training bat (on the right) with front side hitting surface of the training bat facing forward. That portion of both bats in dotted lines shows the relative sweet spots of the two bats. One will note that the sweet spot of the training bat is relatively longer and wider than that of the standard bat of similar length and, as shown in FIG. 5, the width of the sweet spot extends almost the entire width of the front side hitting surface excepting the rounded side edges.

Figure 6:
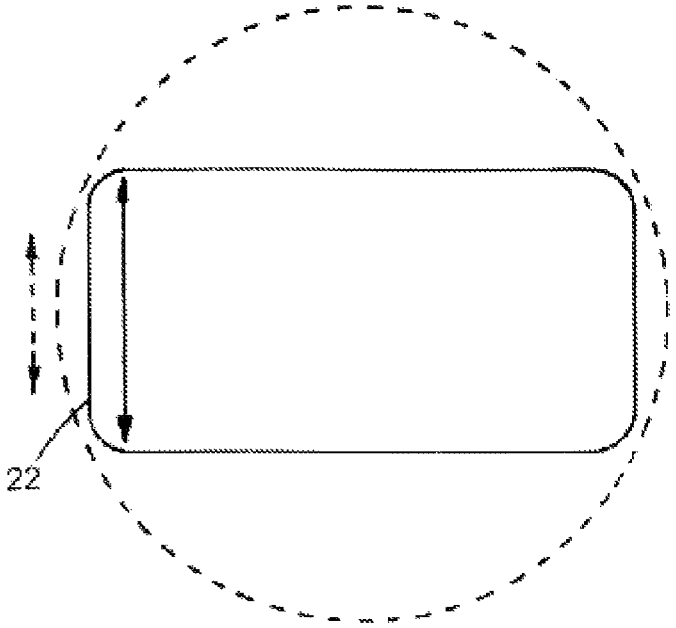
FIG. 6 is a cross-sectional overlapping comparison view of the barrel (or hitting portion) of a standard cylindrical bat relative to substantially rectangular barrel of a training bat consistent with the principles of the invention. It shows the comparative width of the sweet spot on each bat.

FIG. 6 is a cross-sectional overlapping comparison view of the hitting portion of a standard bat relative to the hitting portion of a training bat which in this case is the front side hitting surface 22 consistent with the principles of the invention. For purposes of illustration, the horizontal cross-section of the cylindrical bat is shown in dotted lines and the horizontal cross-section of the training bat is shown in solid lines. The arrows are indicators of the width of the sweet spot for the standard cylindrical bat (dotted) and the training bat (solid). One will note that the intended hitting surface (i.e. that portion of the barrel which will cause the ball to travel along the directly of the swing) of the standard cylindrical bat is significantly narrower than the diameter of the barrel. While technically speaking, any portion of the cylindrical barrel of a standard bat may serve to make some contact with the ball, making contact with the ball such that the barrel strikes the ball substantially above or below the center axis of the barrel will cause the ball to pop up in the air or move downward. In other words, and as previously described, a hitter striking the ball in these areas beyond the central axis of the barrel will hit a foul ball, a grounded ball or cause some other undesirable result. A hitter must make contact with ball using that relatively narrower portion of the standard bat closer to the center axis in order to cause the ball to fly forward. By contrast, the substantially flat hitting surface of the training bat creates a relatively wider hitting surface. And, importantly, making contact with any portion of the hitting surface (other than the rounded edges) will cause the ball to fly forward in the direction of the swing making it less likely that a hitter will "foul" the ball, ground or pop up the ball or cause some other unintended result.

A method for making a preferred embodiment of the training bat depicted in FIGS. 2A and 2B above include taking a four sided elongated wood member which is rectangular cross-section having the edge grain of the wood oriented along the narrower width surface, fashioning a barrel of approximately two thirds the length of the elongated member and a hitting surface one or more of the two narrower width surfaces by rounding the edges of one of the narrower width surfaces where it meets adjacent wider width sides, cutting a handle with a length of less than one third the entire length of the barrel at a desired circumference, fashioning a tapered section to connect the handle with the barrel. An alternative method would be to fashion a barrel of the approximate relative dimensions described in the paragraphs above and attach it with a handle having a knob. The method may include using like materials, different materials, or a combination thereof for making the barrel, tapered section, handle, knob, and cap portions of the training bat described in the paragraphs above.

As one can appreciate from the discussion above, the training bat provides substantial advantages over the standard bat for purposes of training the swing and developing confidence in the hitter. The following is a list of some of these advantages:

1. The elongated hitting surface of the training bat elongates the sweet spot making it easier for the hitter to make solid contact with the ball;
2. The substantially flat hitting surface of the training bat widens the sweet spot making is easier to make solid contact;
3. The substantially flat hitting surface of the training bat ensures that the grain of the bat will line up properly with the ball thus resulting in fewer broken bats;
4. The wider top and bottom sides of the training bat barrel encourage a level swing plane which increases the likelihood of solid contact and increased confidence of the hitter;
5. The training bat allows hitters to utilize a wood bat to develop "feel". In other words, the hitter can take advantage of the unique vibrational characteristics of a wood bat for training without having to worry about breakage or off center hits associated with standard bats which might sting the hitter's hands and discourage use (which is a common issue among hitters of all ages and abilities).

One will note that the training bat described above is for use in ball sports such as baseball and softball which generally involve the use of a cylindrical bat during competitive play. Although the invention has a substantially flat hitting surface for purposes of training the hitters swing, it differs substantially from a cricket bat or similar paddle shaped implement for striking a ball wherein the hitting surface of the bat/paddle is substantially wider than the barrel side surfaces. In the present invention, the hitting surface is narrower than the barrel side surfaces. One will also note that while the barrel of the present invention has uniform side surfaces which are substantially parallel to the substantially flat hitting surface, there is no requirement that those side surfaces be necessarily parallel in that they might, in alternative embodiments, connect a surface opposite the hitting surface which is wider or narrower than the hitting surface.

The present invention has now been described with reference to several embodiments thereof. The entire disclosure of any patent or patent application identified herein is hereby incorporated by reference. The foregoing detailed description and examples have been provided for clarity of understanding only. No unnecessary limitations are to be understood therefrom. It will be apparent to those skilled in the art that many changes can be made in the embodiments described without departing from the scope of the invention. Thus, the scope of the present invention should not be limited to assemblies described herein, but only by the assemblies and methods described by the language of the claims and their equivalents.

What is claimed is:

1. A training bat comprising an elongated four sided wood barrel, a handle, and a tapered section connecting the barrel with the handle, the barrel having a flat front side hitting surface for impacting a ball flat right and left side surfaces perpendicular to the front side hitting surface, a flat back side surface opposite the front side hitting surface and perpendicular to the right and left side surfaces, and a flat top end surface perpendicular to the front back and side surfaces, the barrel is rectangular in horizontal cross-section with the front side hitting surface and the back side is parallel to one another along the entire barrel length, each of the front, back and side surfaces are uniform in width along the barrel length, the front side hitting surface having rounded corner edges where the front side hitting surface meets the right and left side surfaces and the top end surface, the left and right side surfaces are greater in width than the front side hitting surface, the length of the left and right side surfaces are the same as the length of the front side hitting surface measuring from the top end surface edge to the tapered section, the length of the front side hitting surface is in the approximate range of one-half to two-thirds the combined length of the barrel, handle and tapered section, and the width of the front side hitting surface is greater than the width of the handle, wherein the barrel is oriented such that the wood edge grain runs along the entire length of the front side hitting surface such that a ball striking the front hitting surface impacts the edge grain.

2. The training bat of claim 1 wherein the width of the right and left sides of the barrel is greater than the width of the front side hitting surface along the entire length of the barrel.

3. The training bat of claim 1 wherein the barrel front side hitting surface is between 1⅝ inches and 2 inches in width.

4. The training bat of claim 1 wherein the length of the front side hitting surface is in the range of 10 to 18 inches.

5. The training bat of claim 1 wherein the barrel left and right side surfaces are in the range of 3½ inches to 4 inches wide.

6. The training bat of claim 1 wherein the tapered section is rectangular in horizontal cross section.

7. The training bat of claim 1 wherein the handle is cylindrical.

8. The training bat of claim 1 wherein the handle is rectangular in horizontal cross section.

9. The training bat of claim 1 wherein the handle is square in horizontal cross section.

10. The training bat of claim 1 having a four sided knob that increases in diameter as the knob extends away from the handle toward a handle end opposite the barrel end surface.

11. The training bat of claim 1 wherein the knob is rounded.

12. The training bat of claim 1 wherein a combined length of the handle and tapered section is in the range of 10 to 11 inches long.

13. The training bat of claim 1 comprising a barrel sweet spot having a width which is approximate to the width of the front side hitting surface not including rounded edges.

14. The training bat of claim 1 wherein the handle includes a four sided trapezoidal knob.

15. The training bat of claim 1 wherein the barrel end surface includes a rounded cap.

* * * * *